US009030370B2

(12) United States Patent
Petrovic

(10) Patent No.: US 9,030,370 B2
(45) Date of Patent: May 12, 2015

(54) DISTRIBUTED CONTINUOUS ANTENNA

(71) Applicant: Entropic Communications, Inc., San Diego, CA (US)

(72) Inventor: Branislav Petrovic, La Jolla, CA (US)

(73) Assignee: Entropic Communications, Inc., San Diego, CA (US)

( * ) Notice: Subject to any disclaimer, the term of this patent is extended or adjusted under 35 U.S.C. 154(b) by 316 days.

(21) Appl. No.: 13/647,016

(22) Filed: Oct. 8, 2012

(65) Prior Publication Data

US 2013/0093643 A1 Apr. 18, 2013

Related U.S. Application Data

(60) Provisional application No. 61/546,538, filed on Oct. 12, 2011.

(51) Int. Cl.

| | |
|---|---|
| ***H01Q 1/50*** | (2006.01) |
| ***H01Q 1/44*** | (2006.01) |
| ***H01Q 1/00*** | (2006.01) |
| ***H01Q 5/00*** | (2006.01) |

(52) U.S. Cl.

CPC ..... *H01Q 1/007* (2013.01); *H01Q 1/44* (2013.01); *H01Q 5/0072* (2013.01)

(58) Field of Classification Search

CPC ..... H01Q 1/44; H01Q 5/0072
USPC ..... 343/790, 791, 850, 857, 859
See application file for complete search history.

(56) References Cited

U.S. PATENT DOCUMENTS 5,019,830 A * 5/1991 Harada ..... 343/701
8,080,734 B2 * 12/2011 Mukai et al. ..... 174/102 R

* cited by examiner

*Primary Examiner* — Hoang V Nguyen
(74) *Attorney, Agent, or Firm* — Richard Bachand

(57) ABSTRACT

A distributed continuous antenna for wireless communication includes a first section of coaxial cable having a center conductor and an outer shield; and an antenna lead having a first end electrically connected at an injection point of the outer shield of the coaxial cable, and having a second end configured to be coupled to a device radio for the purpose of transmitting or receiving signals using the outer shield of the coaxial cable as an antenna for the device radio. The distributed continuous antenna might include a plurality of leads electrically connected to the outer shield of the coaxial cable at a first end and configured to have a second end coupled to a device radio for the purpose of transmitting or receiving signals using the outer shield of the coaxial cable as an antenna for the device radio.

17 Claims, 6 Drawing Sheets

DISTRIBUTED CONTINUOUS ANTENNA

CROSS REFERENCE TO RELATED APPLICATIONS

This application claims the benefit of U.S. Provisional Application No. 61/546,538, filed Oct. 12, 2011, titled Distributed Continuous Antenna, which is hereby incorporated herein by reference in its entirety.

TECHNICAL FIELD

The present invention relates generally to network communication devices, and more particularly, some embodiments relate to a distributed continuous antenna for network devices.

DESCRIPTION OF THE RELATED ART

A local network may include several types of devices configured to deliver subscriber services throughout a home, office or other like environment. These subscriber services include delivering multimedia content, such as streaming audio and video, to devices located throughout the location. As the number of available subscriber services has increased and they become more popular, the number of devices being connected the home network has also increased. The increase in the number of services and devices increases the complexity of coordinating communication between the network nodes. This increase also generally tends to increase the amount and types of traffic carried on the network.

The network of FIG. 1 is one example of a multimedia network implemented in a home. In this example, a wired communications medium 100 is shown. The wired communications medium might be a coaxial cable system, a power line system, a fiber optic cable system, an Ethernet cable system, or other similar communications medium. Alternatively, the communications medium might be a wireless transmission system. As one example of a wired communication medium, with a Multimedia over Coax Alliance (MoCA®)) network, the communications medium 100 is coaxial cabling deployed within a residence 101 or other environment. The systems and methods described herein are often discussed in terms of this example coaxial network application, however, after reading this description, one of ordinary skill in the art will understand how these systems and methods can be implemented in alternative network applications as well as in environments other than the home.

The network of FIG. 1 comprises a plurality of network nodes 102, 103, 104, 105, 106 in communication according to a communications protocol. For example, the communications protocol might conform to a networking standard, such as the well-known MoCA standard. Nodes in such a network can be associated with a variety of devices. For example, in a system deployed in a residence 101, a node may be a network communications module associated with one of the computers 109 or 110. Such nodes allow the computers 109, 110 to communicate on the communications medium 100. Alternatively, a node may be a module associated with a television 111 to allow the television to receive and display media streamed from one or more other network nodes. A node might also be associated with a speaker or other media playing devices that plays music. A node might also be associated with a module configured to interface with an internet or cable service provider 112, for example to provide Internet access, digital video recording capabilities, media streaming functions, or network management services to the residence 101. Also, televisions 107, set-top boxes 108 and other devices may be configured to include sufficient functionality integrated therein to communicate directly with the network.

With the many continued advancements in communications technology, more and more devices are being introduced in both the consumer and commercial sectors with advanced communications capabilities. Many of these devices are equipped with communication modules that can communicate over the wired network (e.g., over a MoCA Coaxial Network) as well as modules that can communicate wirelessly with other devices. Indeed, many homes also have a wireless network, such as a WiFi network that complies with IEEE 802.11. In some instances, it is advantageous for devices that communicate over the MoCA network to communicate over the WiFi network as well. Such "hybrid" configurations allow nodes to share MoCA information received over the hardwired network with other devices connected via WiFi. With such configurations, a hybrid device that is hardwired to the MoCA network can send information it received over the hardwired network to devices that are portable and that rely on the WiFi connection to receive information.

For example, video content (such as a movie) may enter the home from the internet over a cable modem. The cable modem may then communicate with a set top box within the home over a MoCA network. In addition, the cable modem may be connected to a storage device that services the network by storing content to be distributed to devices within the home. That content may then be communicated to devices connected to the WiFi network through any of the MoCA devices that can serve as a bridge to the WiFi network.

Communications engineers face several challenges today, including finding ways to transmit signals without taking up large amounts of space with antennas and without requiring large amounts of power to ensure that signals that are transmitted can be reliably received by the receivers intended to receive the transmitted signals.

BRIEF SUMMARY OF EMBODIMENTS OF THE INVENTION

According to embodiments of the systems and methods described herein, various configurations for distributed antennas and network devices for communication with distributed antennas are provided. In various embodiments, a distributed continuous antenna includes a first section of coaxial cable having a center conductor and an outer shield; and an antenna lead having a first end electrically connected at an injection point of an outer shield of the coaxial cable, and having a second end configured to be coupled to a device radio for the purpose of transmitting or receiving signals using the outer shield of the coaxial cable as an antenna for the device radio.

In some embodiments, the antenna can include multiple leads electrically connected to the outer shield of the coaxial cable at a first end and configured to have a second end coupled to a device radio for the purpose of transmitting or receiving signals using the outer shield of the coaxial cable as an antenna for the device radio.

Spacing between injection points of the leads can be an odd multiple of one-quarter of the wavelength of an operating frequency of the device radio, while in other embodiments, spacing between injection points of the leads is a percentage of an odd multiple of one-quarter of the wavelength of an operating frequency of the device radio, wherein the percentage is other than 100%. In some embodiments, the shield of the coaxial cable is grounded. In further embodiments, an impedance is placed between the shield and the ground. In some embodiments, the impedance is sufficient to isolate signals injected onto the coaxial shield from the ground.

A network device, can be configured to include a wireless communication module and an antenna lead electrically connected to the wireless communication module and configured to be electrically connected to a distributed antenna; wherein the distributed antenna comprises a first section of coaxial cable having a center conductor and an outer shield; and the antenna lead is configured to be electrically connected to an outer shield of the coaxial cable at an injection point.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the accompanying figures. The drawings are provided for purposes of illustration only and merely depict typical or example embodiments of the invention. These drawings are provided to facilitate the reader's understanding of the systems and methods described herein and shall not be considered limiting of the breadth, scope, or applicability of the claimed invention.

Figure 1:
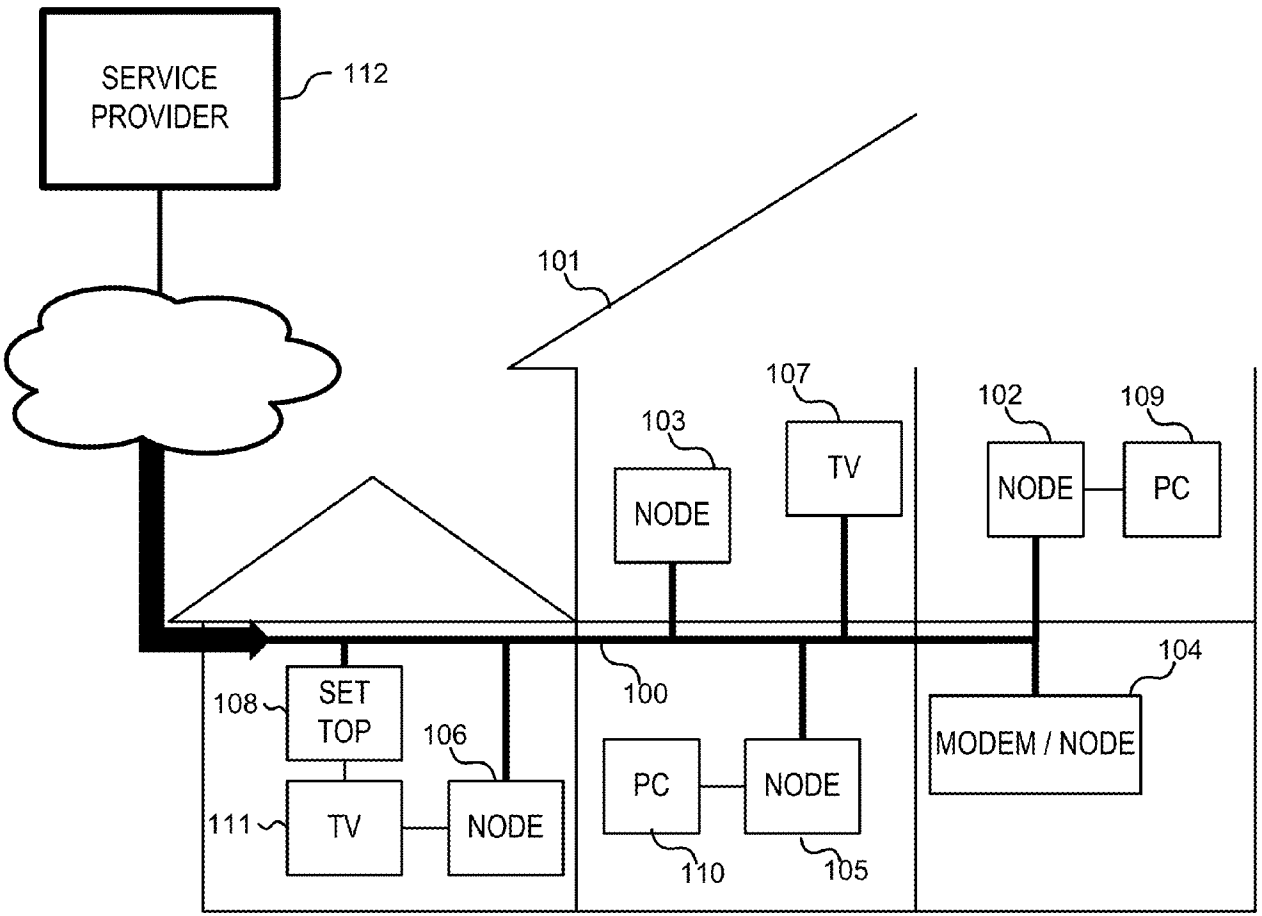
FIG. 1 is a diagram illustrating one example of a home network environment with which the systems and methods described herein can be implemented.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

Systems and methods described herein include the use of a wired network infrastructure, such as a coaxial cable or power line network as an antenna for wireless communications. One or more devices can be configured to have their antenna lead or leads connected to the wired infrastructure to use the wired infrastructure as an antenna. For example, a wireless device with a wireless communication module, such as a wireless transmitter, receiver, or transceiver (i.e., a radio), can be configured with its antenna lead (e.g., a lead that might otherwise be connected to a conventional antenna) connected to the coaxial cable or power line. As a further example, the wireless device can have its antenna lead connected to the shield of the coaxial cable, and use the shield as its antenna. The device can include a controller to control device operations such as transmitter/receiver switching operations, matching network tuning, feedback analysis and the like. The controller can be dedicated to the transmit/receive and antenna functions, or it can be a controller shared with other device functionality.

One embodiment of the presently disclosed method and apparatus provides a system in which wired network infrastructure is used as an antenna to launch signals to be wirelessly transmitted over a wireless network. For example, in some embodiments, the shield of a coaxial cable is used as an antenna to launch signals to be wirelessly transmitted over a WiFi or other wireless network. In accordance with one such embodiment, a signal is coupled to the outer coax shield. In another embodiment, the signal is coupled to power line wires as an antenna to launch wireless signals.

In various embodiments, one or more antennas can be used with spaced injection points. In one embodiment, the antenna injection points are spaced at intervals selected as wavelength multiples. For example, in some embodiments the injection points can be spaced at intervals of ¼λ, ¾λ, or the like. In an alternative embodiment, the antenna injection points are spaced at non-uniform intervals. Using this architecture, sections of, or the entire, home cable network becomes an antenna shared by transmit and receive devices connected thereto.

The gain of such a distributed antenna may be high with rich multipath. In one embodiment, very high frequency (VHF) ultra-high frequency (UHF) and frequencies above 1 GHz can be used. In one embodiment, several frequency bands can be used concurrently or simultaneously. In one such case, the antenna may be tunable to match the impedance of the antenna to optimize the amount of energy transferred, or impedance matching networks can be included.

Figure 2:
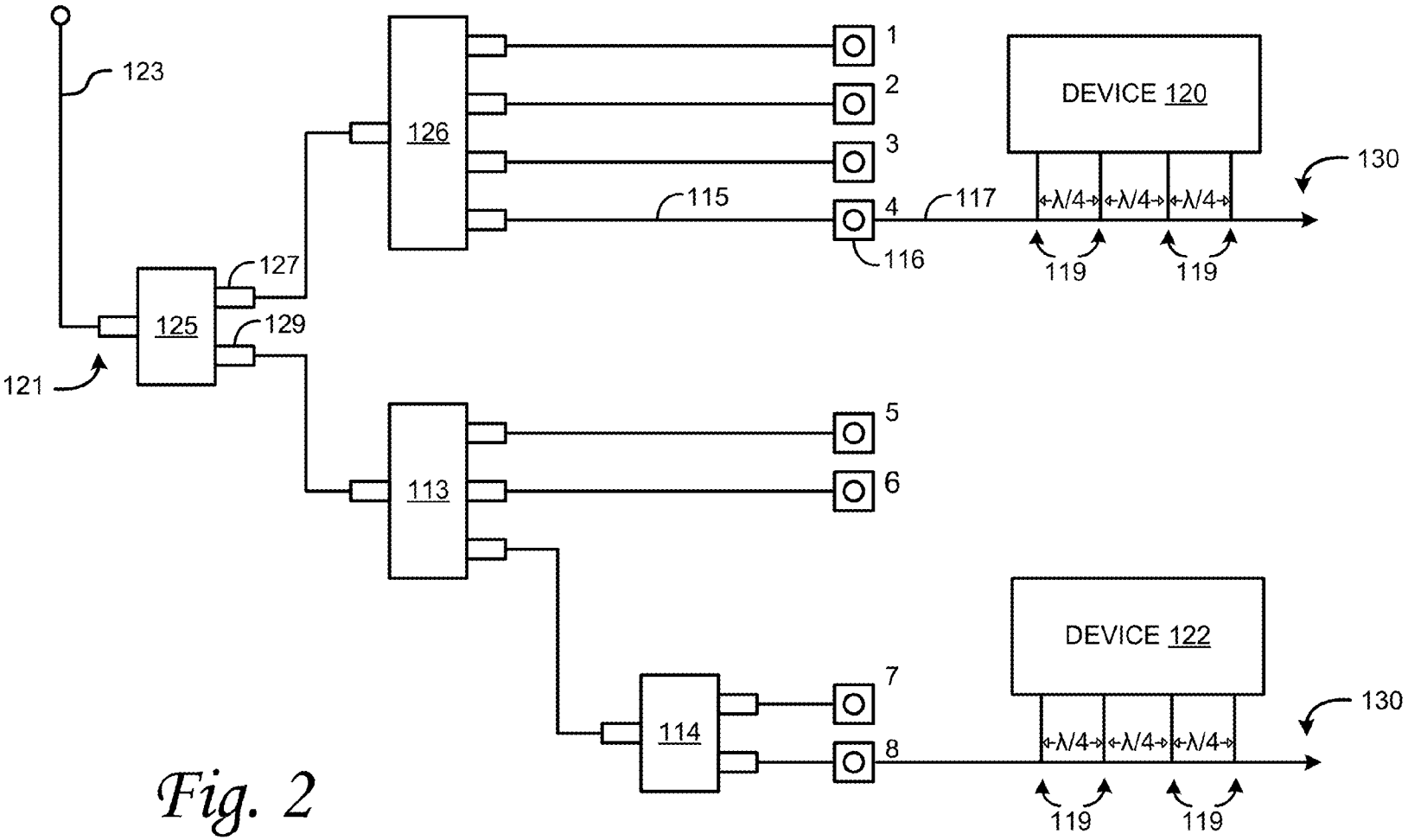
FIG. 2 is a diagram illustrating an example of a network using a distributed continuous antenna in accordance with one embodiment of the systems and methods described herein.

FIG. 2 is an illustration of an example of a network using a distributed continuous antenna in accordance with one embodiment of the systems and methods described herein. A point of entry (POE) 121 is present at the point at which information from outside the home enters the home network. In the embodiment shown in FIG. 2, a cable drop 123 is coupled to the external side of the POE 121. A signal is applied to or injected into the cable. The signal can, for example, be a cable or satellite TV signal, which can include 'broadcast' program content, telephone and modem signals, and streaming content.

The signal traverses the drop cable to the POE 121. In the illustrated example, a 2:1 splitter 125 splits the power of the signal and sends half the power through a first output port 127 of splitter 125 and half the power through a second output port 129 of splitter 125.

In this example, the first output 127 is coupled to a section of coaxial cable, which is coupled to the input of a first 4:1 splitter 126. The second output 129 is coupled to a coaxial cable, which is coupled to a second 4:1 splitter 113. The four outputs of the first 4:1 splitter 126 are each coupled to their respective sections of coaxial cable. Each of these four sections of coaxial cable services a different room (e.g., room 1, room 2, room 3 and room 4), or multiple runs can be provided to a single room or area. From output 129, splitters 113 and 114 further split the signal to provide service to rooms 5 through 8. Each of the rooms 1 through 8 in the illustrated example includes a coaxial cable outlet or jack (e.g., an RJ-6 jack, although other outlets can be used) to which coaxial cable can be attached, and the attached cable run to connect a set-top box, television, cable modem or other like device, thereby connecting the device to the cable backbone.

As shown in FIG. 2, a section of coaxial cable 115 is coupled between splitter 126 and room 4. At room 4, a section of coaxial cable 117 is coupled to a coax cable outlet 116. A series of antenna leads are connected from device 120 to cable 117, each at their respective injection points 119. A device 120 can be implemented as any of a number of electronic devices having a wireless communication capability. In the example illustrated in FIG. 2, device 120 has four antenna leads for communication using four separate antennas. For example, this can be a 4×4 MIMO device having four antennas. In such an application, four leads are used to inject the signal at four points of the shield of coaxial cable 117. To avoid interference between leads, the leads can be separated at the injection points 119 by wavelength multiples of the injected signal. This can be particularly effective where the signals on each lead are all at the same center frequency.

In various embodiments, the signal line of the antenna leads is connected to the shield of coaxial cable 117. The antenna leads can be connected at regular intervals, such as, for example, odd quarter-wavelength multiples of the anticipated center frequency, although other intervals can be used. In other embodiments, the spacing between the leads can be non-uniform. In the example illustrated in FIG. 2, the antenna leads are separated by a distance $\lambda/4$, although other multiples can be used. In another embodiment, the spacing is slightly less than or slightly greater than an odd quarter-wavelength multiple. This can avoid a situation where spacing between non-adjacent leads is ½ or a full wavelength. For example, if the spacing in FIG. 2 were ¼ wavelength, every other lead would be spaced by ½ wavelength, causing interference. Accordingly, in some embodiments, the leads are spaced at an interval that is slightly off from $\lambda/4$. For example, in some embodiments the spacing can be 60-95% $\lambda/4$. In further embodiments, the spacing can be 80-90% $\lambda/4$. In still further embodiments, the spacing can be 80-85% $\lambda/4$. In other embodiments, other spacing can be used and the spacing can be slightly greater than $\lambda/4$.

In accordance with some embodiments, the coaxial cable 117 can be coupled to (e.g., terminated at) device 120 or to one or more devices at the end 130. In other embodiments, the coaxial cable 117 is left open, shorted, or terminated at the end.

The lengths of the coaxial cable runs can vary as appropriate for a given installation. Also, rather than eight rooms or outlets, different installations may service a different number of rooms or have a different number of outlets. Furthermore, rather than using four separate splitters to service the rooms, other numbers of splitters, whether fewer or greater numbers, can be used. For example, in the eight-room example of FIG. 2, a single 8-way splitter could be used, a 2-way and two 4-way splitters could be used, or other configurations are possible.

Also illustrated in the example implementation of FIG. 2 is a second network device 122 that can also be connected to the coaxial cable plant. In the illustrated example, the network device 122 is connected in a similar fashion as network device 120, using four antenna leads spaced at one quarter wavelength intervals for 4×4 MIMO operation. Although two networked devices are illustrated in the example of FIG. 2, a greater or fewer number of wireless devices can be coupled to coaxial cable runs in these or other rooms of the installation.

With quarter-wavelength spacing or odd integer multiples thereof, the injection points can be substantially isolated from each other and signals can be injected onto the coaxial shield and combined with low loss. This isolation can be important for operation of MIMO antennas as well as for beam forming.

As illustrated in FIG. 2, the coaxial section 117 can be connected to a plurality other coaxial cables through jacks or splitters. Accordingly, additional sections of coaxial cable beyond section 117 can act as an antenna and radiate signals. In applications where electrically connected coaxial cables are distributed throughout the home (or other location), the antenna can also be distributed throughout the location. Accordingly, even if the radiation properties of the coaxial cable are less than ideal because matching cannot sufficiently match the proper resonant frequency (e.g., the antenna yields poor VSWRs), having the radiative elements (lengths of coaxial cable) distributed throughout the network premises can still provide improved signal strength to a receiver at an otherwise remote location on the premises.

Figure 3:
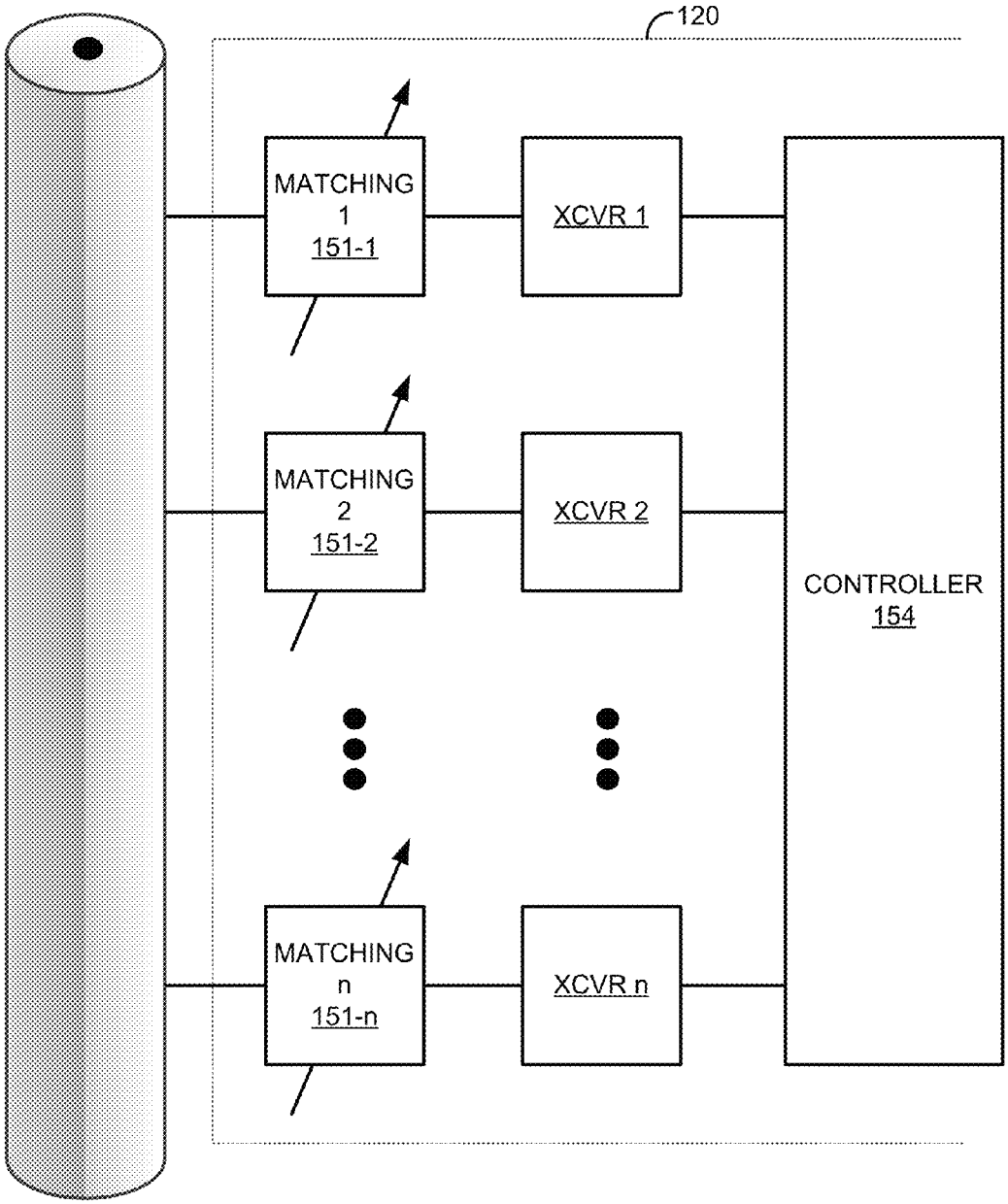
FIG. 3 is a diagram illustrating an application using matching networks to match wireless transmitters to the coaxial antenna in accordance with one embodiment of the systems and methods described herein.

FIG. 3 is a diagram illustrating an application using matching networks to match wireless transmitters to the coaxial antenna in accordance with one embodiment of the systems and methods described herein. Referring now to FIG. 3, in the illustrated example network device 120 includes n transceivers (where n is an integer number), XCVR1 through XCVRn. For each transceiver XCVR1-XCVRn, a matching network 151 (151-1-151-*n*) is provided. Preferably, the matching circuits are optimized for maximum power transfer. In one embodiment, the matching circuits are fixed circuits, and can be set up based on anticipated system characteristics. In other embodiments, tunable networks can be provided to allow the matching network to be tuned to improve power transfer. The example configuration illustrated in FIG. 3, shows a system that is equivalent to an n-antenna array.

In one embodiment, the receiving devices can measure the received power, such as the signal strength of signals received from a given transmitter, and can be configured to provide feedback to the transmitter regarding the received signal strength. This feedback can be used, for example in an iterative fashion, to the tune the matching network according to the feedback. For example, the matching networks can be adjusted while feedback on the device's received power at another node is monitored and the network tuned to improve, maximize or approximately maximize received signal strength at a receiving node. Accordingly, in some embodiments, a controller 154 can be used to receive the feedback and to tune the matching networks. Additionally the controller 154 can be used to measure the signal strength of other transmitters and to provide feedback on signal strength measurements to those transmitters. Controller 154 can be implemented using a general-purpose processor, a DSP or other processing module. In still further embodiments, tuning pots or other tuning mechanisms can be provided to allow local calibration of the matching networks at the time of installation and during operation.

In some embodiments, the feedback can be provided by other network devices reporting received signal strength to the transmitter. In other embodiments, a dedicated tuning device can be used to make signal strength measurements from one or more network devices and to provide feedback to the transmitter(s) regarding signal strength. The transmitter(s) can use this information to tune their matching networks.

As noted above, in one embodiment, the distances d1, d2, . . . , dn−1 between injection points are equidistant and substantially equal to a quarter wavelength ($\frac{1}{4}\lambda$) at the operating frequency, or a multiple thereof. In another embodiment, the distances can begin at a quarter wavelength and progressively increase such as incrementally increasing by half-wavelength increments at the operating frequency. In embodiments where the spacing between leads is equal at one-quarter wavelength of the operating frequency, every other injection point will be separated by one-half wavelength. Accordingly, there would not be high isolation between these two points. This could be problematic for certain applications. Accordingly, in some embodiments, non-uniform spacing can be used, as can spacing slightly greater or less than ¼λ can be used.

In embodiments in which the antenna leads of a device (e.g., device 120) are connected to the shield of the coaxial cable, the ground plane of circuits in the device should not be connected to the same ground as the coaxial shield. Where circuits are grounded to the same plane as the coaxial cable, and impedance can be provided between the shield and the ground plane so as to not effectively result in a short of the antenna lead to ground. Alternatively, in some applications, the coaxial shield is not grounded and a single-wire connection can be made from each matching circuit to the shield. In other words, the ground can be provided through radiation returning in the air.

Figure 4:
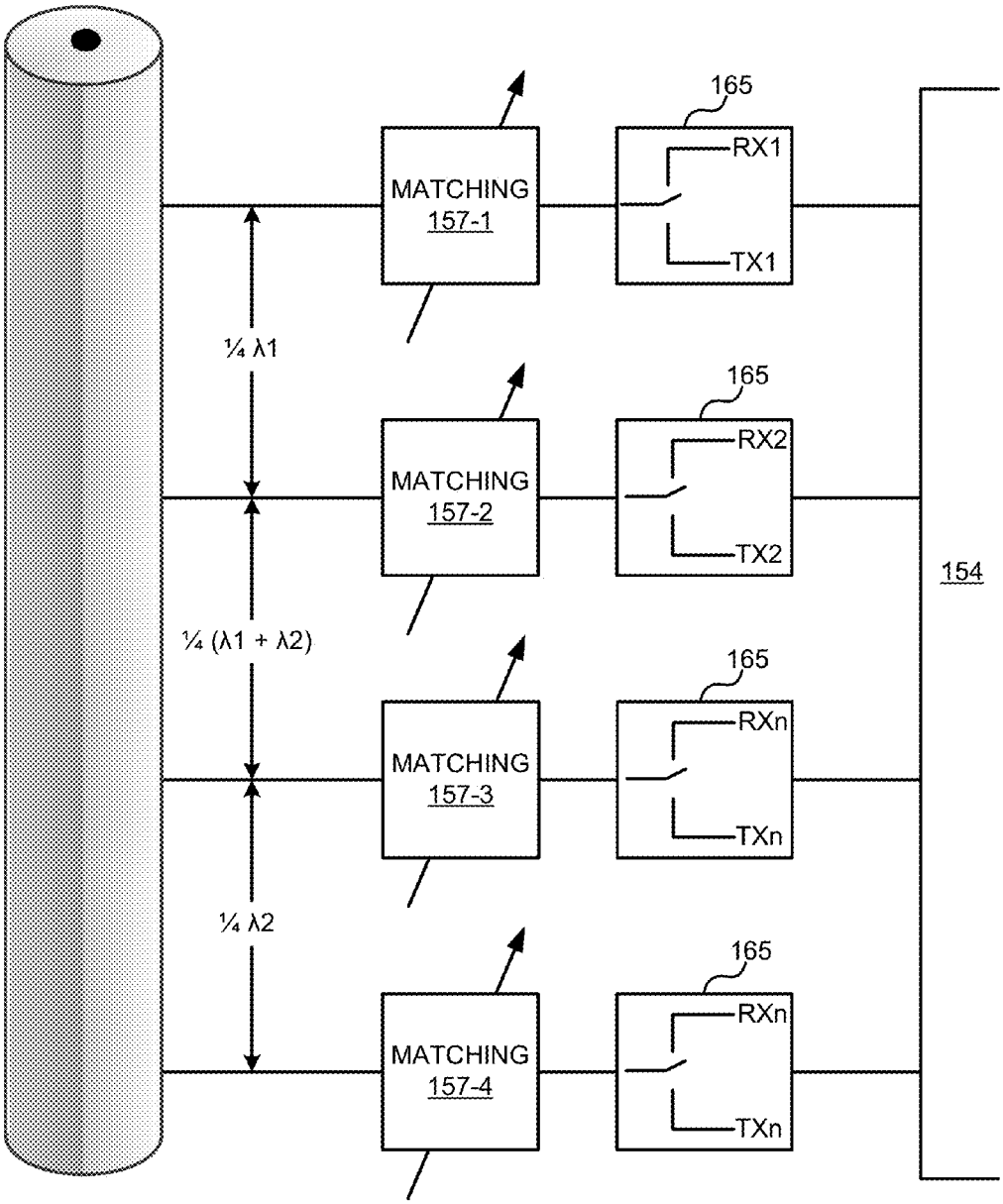
FIG. 4 is a diagram illustrating an example of a TDD system operating at two different bands in accordance with one embodiment of the systems and methods described herein.

The systems and methods described herein can be implemented as a time division multiplexing (TDD) system or a frequency division multiplexing (FDD) system. With a TDD system, receive and transmit operations occur one at a time at the same frequency, whereas with an FDD system, transmit and receive operations may occur at the same time, but at different frequencies. FIG. 4 is a diagram illustrating an example of a TDD system operating at two different bands (i.e. a dual-band concurrent operation) in accordance with one embodiment of the systems and methods described herein. Referring now to FIG. 4, in this example, the device includes four transmit and receive channels 165. In particular, the illustrated example operates at two frequency bands, f1, having a wavelength λ1 and f2 having a wavelength λ2. Matching networks 157-1 and 157-2 operate at frequency f1, while matching networks 157-3 and 157-4 operate at frequency f2.

Accordingly, to avoid or reduce interference between each pair of corresponding matching networks, the spacing between adjacent leads in each frequency f1 and f2 are one-quarter wavelength of that frequency. Accordingly, the spacing between leads of matching networks 157-1 and 157-2 is ¼λ1, and the spacing between leads of matching networks 157-3 and 157-4 is ¼λ2. The spacing between adjacent leads of the two different frequency bands can be the average of one-quarter the distance of the sum or average of the two wavelengths. In other embodiments, for operation in two or more different frequency bands (or in the case of an FDD system), distances can be optimized at an average of the wavelengths.

With a system operating at two different bands, this is the equivalent of having a 2×2 MIMO system operating at two different frequencies with two antennas each. As a further example, the configuration illustrated in FIG. 4 can represent a configuration having two Wi-Fi bands, one at 2.4 GHz and one at 5 GHz, each having a 2×2 MIMO configuration.

Figure 5:
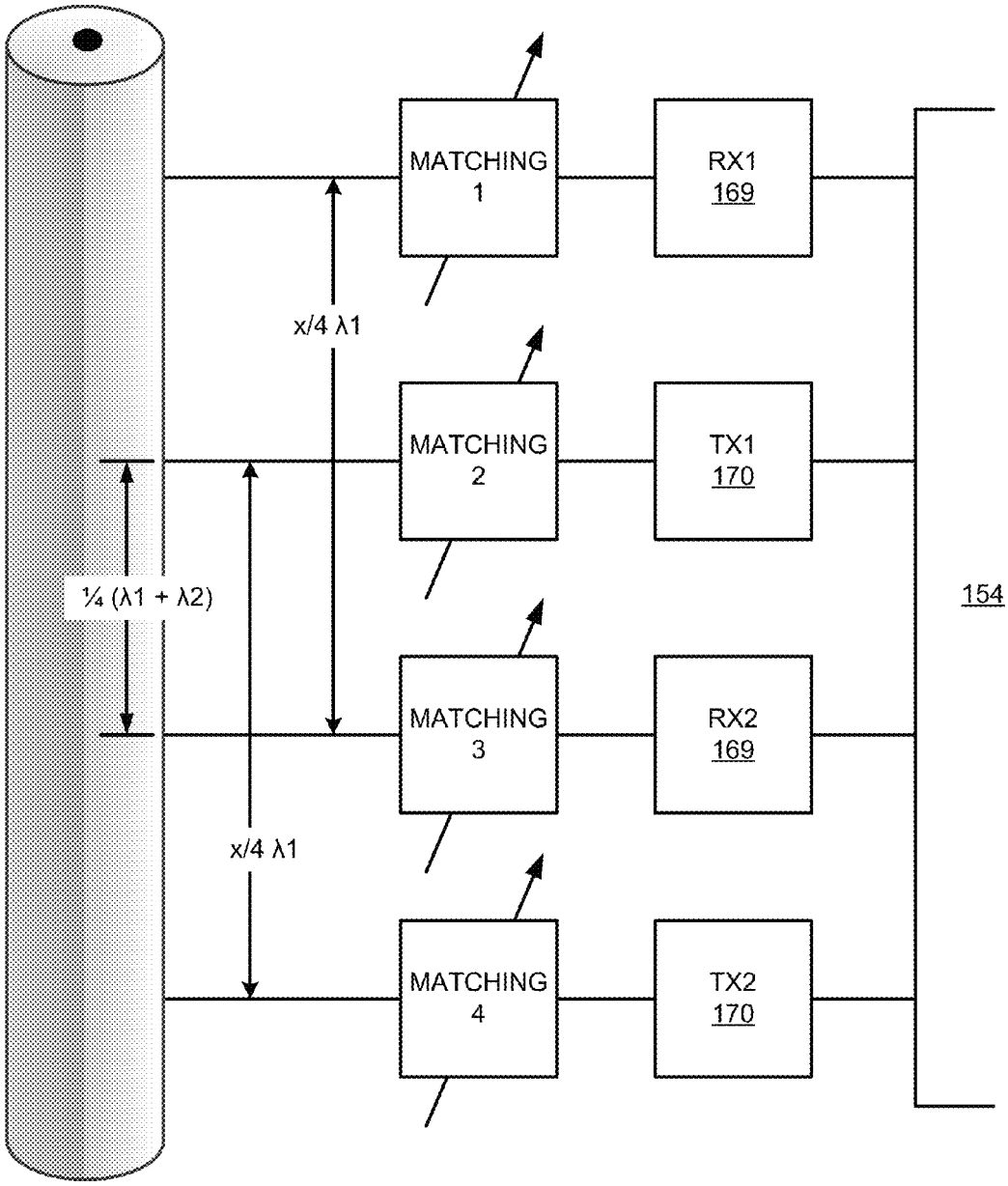
FIG. 5 is a diagram illustrating an example of distances optimized for an FDD system in accordance with one embodiment of the systems and methods described herein.

FIG. 5 is a diagram illustrating an example of distances optimized for an FDD system. In this example, transmitters 170 and receivers 169 are grouped together in receiver-transmitter pairs. In this example where the receivers are operating at one frequency band, f1, and the transmitters are operating at another frequency band, f2, the spacing is arranged such that the leads of the receivers are separated by odd multiples (designated as x in FIG. 5) of ¼λ1. Likewise, spacing is arranged such that the leads of the transmitters are separated by odd multiples of ¼λ2.

Alternatively, the grouping can be done on the receiver and transmitter basis for example, receiver one in receiver two can be grouped together with quarter wave distances separating their leads, and transmitter one and transmitter to group together with quarter wavelength distances separating their leads, and an average quarter wave distance provided to separate the leads between the two groups.

This can be analogized to a system having two frequencies and two antennas each (i.e. a 2×2 MIMO). In other words, the system can have a MIMO for receive and another MIMO for transmit operations.

Where components or modules of the invention are implemented in whole or in part using software, in one embodiment, these software elements can be implemented to operate with a computing or processing module capable of carrying out the functionality described with respect thereto. An example of this is the controller that can be included in the network devices. One example of a computing module is shown in more detail in FIG. 6. Various embodiments are described in terms of this example-computing module 200. After reading this description, it will become apparent to a person skilled in the relevant art how to implement the invention using other computing modules or architectures.

Figure 6:
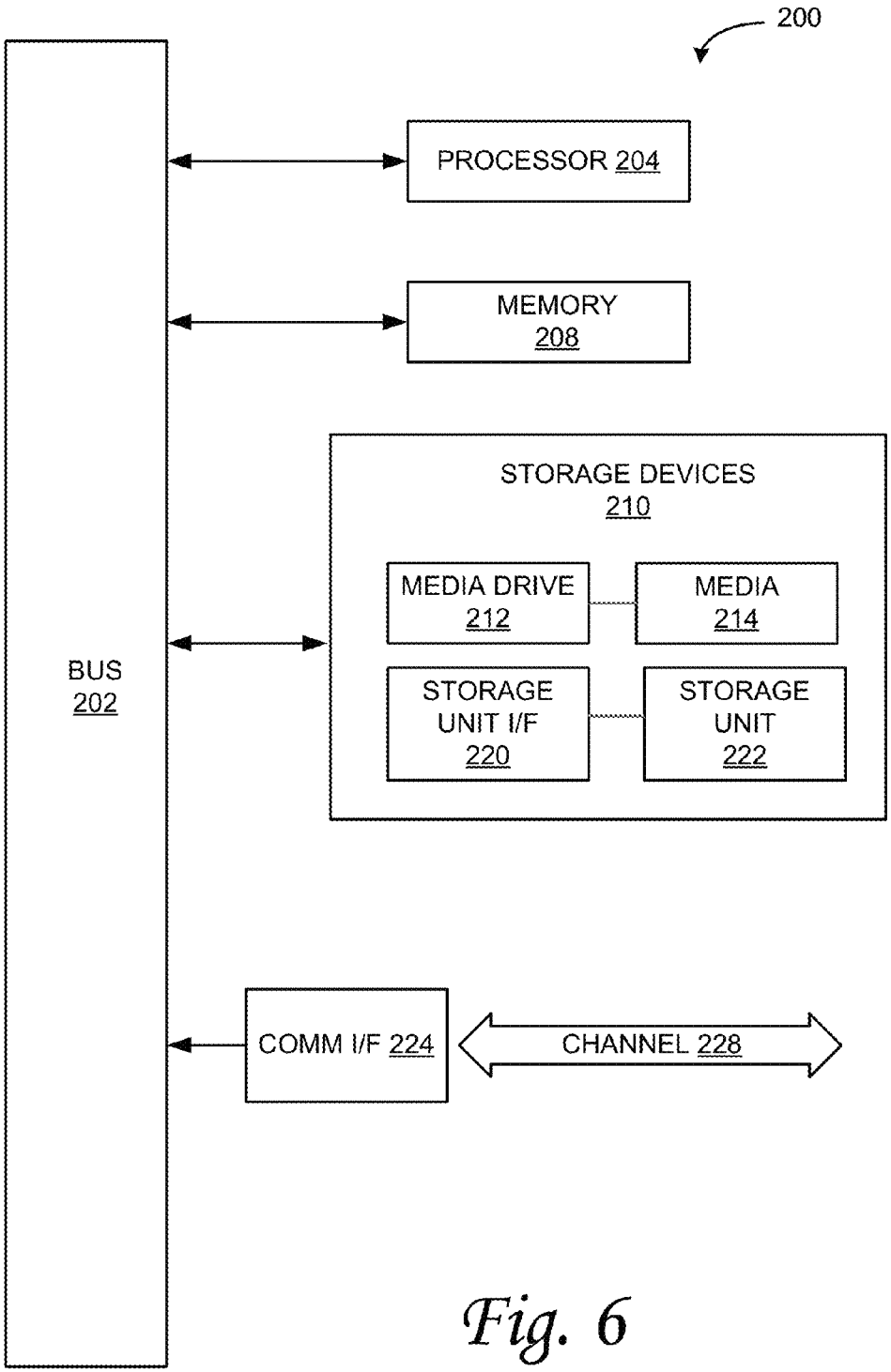
FIG. 6 is a diagram illustrating one example of a computing module in accordance with one embodiment of the systems and methods described herein.

Referring now to FIG. 6, computing module 200 may represent, for example, computing or processing capabilities found within desktop, laptop and notebook computers; handheld computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 200 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 200 might include, for example, one or more processors, controllers, control modules, or other processing devices, such as a processor 204. Processor 204 might be implemented using a general-purpose or special-purpose processing engine such as, for example, a microprocessor, controller, or other control logic. In the illustrated example, processor 204 is connected to a bus 202, although any communication medium can be used to facilitate interaction with other components of computing module 200 or to communicate externally.

Computing module 200 might also include one or more memory modules, simply referred to herein as main memory 208. For example, preferably random access memory (RAM) or other dynamic memory, might be used for storing information and instructions to be executed by processor 204. Main memory 208 might also be used for storing temporary variables or other intermediate information during execution of instructions to be executed by processor 204. Computing module 200 might likewise include a read only memory ("ROM") or other static storage device coupled to bus 202 for storing static information and instructions for processor 204.

The computing module 200 might also include one or more various forms of information storage mechanism 210, which might include, for example, a media drive 212 and a storage unit interface 220. The media drive 212 might include a drive or other mechanism to support fixed or removable storage media 214. For example, a hard disk drive, a floppy disk drive, a magnetic tape drive, an optical disk drive, a CD or DVD drive (R or RW), or other removable or fixed media drive might be provided. Accordingly, storage media 214 might include, for example, a hard disk, a floppy disk, magnetic tape, cartridge, optical disk, a CD or DVD, or other fixed or removable medium that is read by, written to or accessed by media drive 212. As these examples illustrate, the storage media 214 can include a computer usable storage medium having stored therein computer software or data.

In alternative embodiments, information storage mechanism 210 might include other similar instrumentalities for allowing computer programs or other instructions or data to be loaded into computing module 200. Such instrumentalities might include, for example, a fixed or removable storage unit 222 and an interface 220. Examples of such storage units 222 and interfaces 220 can include a program cartridge and cartridge interface, a removable memory (for example, a flash memory or other removable memory module) and memory slot, a PCMCIA slot and card, and other fixed or removable storage units 222 and interfaces 220 that allow software and data to be transferred from the storage unit 222 to computing module 200.

Computing module 200 might also include a communications interface 224. Communications interface 224 might be used to allow software and data to be transferred between computing module 200 and external devices. Examples of communications interface 224 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 224 might typically be carried on signals, which can be electronic, electromagnetic (which includes optical) or other signals capable of being exchanged by a given communications interface 224. These signals might be provided to communications interface 224 via a channel 228. This channel 228 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 208, and storage devices such as storage unit 220, and media 214. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 200 to perform features or functions of the present invention as discussed herein.

Although the systems and methods set forth herein are described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A distributed continuous antenna, comprising:

a first section of coaxial cable having a center conductor and an outer shield;

a plurality of antenna leads, each having a first end electrically connected at an injection point of the outer shield of the coaxial cable, and having a second end configured to be coupled to a device radio for the purpose of transmitting or receiving signals using the outer shield of the coaxial cable as an antenna for the device radio.

2. The distributed continuous antenna of claim 1, wherein spacing between injection points of the antenna leads is an odd multiple of one-quarter of a wavelength of an operating frequency of the device radio.

3. The distributed continuous antenna of claim 1, wherein spacing between injection points of the antenna leads is a percentage of an odd multiple of one-quarter of a wavelength of an operating frequency of the device radio, wherein the percentage is other than 100%.

4. The distributed continuous antenna of claim 1, wherein the device is configured to operate at a first frequency having a first wavelength and a second frequency having a second wavelength, and the device uses a MIMO configuration for each frequency, wherein first and second antenna leads are configured for operation at the first frequency, and third and fourth antenna leads are configured for operation at the second frequency, and wherein spacing between injection points of the first and second antenna leads is x/4 of the first wavelength, and spacing between injection points of the third and fourth antenna leads is x/4 of the second wavelength, where x is an odd integer multiple.

5. The distributed continuous antenna of claim 4, wherein spacing between an immediately adjacent pair of injection points for the first and second frequency is an odd integer multiple of the average of the first and second wavelengths.

6. The distributed continuous antenna of claim 1, further comprising an impedance between the shield of the coaxial cable and a ground to which the shield is connected.

7. The distributed continuous antenna of claim 1, wherein the first section of coaxial cable is electrically connected to one or more other sections of coaxial cable, and the combination of the first section of coaxial cable and the one or more other sections of coaxial cable serve as a radiating element of the antenna.

8. A distributed continuous antenna, comprising:

a first section of coaxial cable having a center conductor and an outer shield;

a plurality of antenna leads coupled between a device radio and the outer shield of the coaxial cable for the purpose of transmitting or receiving signals using the outer shield of the coaxial cable as an antenna for the device radio.

9. The distributed continuous antenna of claim 8, wherein the radio comprises a transmitter, a receiver, or a transceiver.

10. The distributed continuous antenna of claim 8, wherein the first section of coaxial cable is a section of coaxial cable connected to a plurality of other sections of coaxial cable.

11. A network device, comprising:

a wireless communication module; and a plurality of antenna leads electrically connected to the wireless communication module and configured to be electrically connected to a distributed antenna;

wherein the distributed antenna comprises a first section of coaxial cable having a center conductor and an outer shield; and wherein the antenna leads are configured to be electrically connected to an outer shield of the coaxial cable at respective injection points.

12. The network device of claim 11, wherein spacing between injection points of the antenna leads is an odd multiple of one-quarter of a wavelength of an operating frequency of the wireless communication module.

13. The network device of claim 11, wherein spacing between injection points of the leads is a percentage of an odd multiple of one-quarter of a wavelength of an operating frequency of the device radio, wherein the percentage is other than 100%.

14. The network device of claim 11, wherein the device is configured to operate at a first frequency having a first wavelength and a second frequency having a second wavelength, and the device uses a MIMO configuration for each frequency, wherein first and second antenna leads are configured for operation at the first frequency, and third and fourth antenna leads are configured for operation at the second frequency, and wherein spacing between injection points of the first and second antenna leads is x/4 of the first wavelength, and spacing between injection points of the third and fourth antenna leads is x/4 of the second wavelength, where x is an odd integer multiple.

15. The network device of claim 14, wherein spacing between an immediately adjacent pair of injection points for the first and second frequency is an odd integer multiple of the average of the first and second wavelengths.

16. The network device of claim 11, wherein the device is configured to transmit at first frequency having a first wavelength and receive at a second frequency having a second wavelength, and the device uses a MIMO configuration comprising two antennas for each frequency, wherein first and second antenna leads are configured for operation at the first frequency, and third and fourth antenna leads are configured for operation at the second frequency, and wherein spacing between injection points of the first and second antenna leads is x/4 of the first wavelength, and spacing between injection points of the third and fourth antenna leads is x/4 of the second wavelength, where x is an odd integer multiple.

17. The network device of claim 16, wherein spacing between an immediately adjacent pair of injection points for the first and second frequency is an odd integer multiple of the average of the first and second wavelengths.

* * * * *